US009752108B2

(12) United States Patent
Guida et al.

(10) Patent No.: US 9,752,108 B2
(45) Date of Patent: Sep. 5, 2017

(54) EXTERNAL STRUCTURING SYSTEM FOR LIQUID LAUNDRY DETERGENT COMPOSITION

(71) Applicant: The Procter & Gamble Company, Cincinnati, OH (US)

(72) Inventors: Vincenzo Guida, Rome (IT); Joris Meert, Bambrugge (BE)

(73) Assignee: The Procter & Gamble Company, Cincinnati, OH (US)

( * ) Notice: Subject to any disclaimer, the term of this patent is extended or adjusted under 35 U.S.C. 154(b) by 105 days.

(21) Appl. No.: 13/964,130

(22) Filed: Aug. 12, 2013

(65) Prior Publication Data

US 2014/0094397 A1 Apr. 3, 2014

(30) Foreign Application Priority Data

Sep. 28, 2012 (EP) ..... 12186496

(51) Int. Cl.

| | |
|---|---|
| ***D06M 10/00*** | (2006.01) |
| ***C11D 17/00*** | (2006.01) |
| ***C11D 1/22*** | (2006.01) |
| ***C11D 3/04*** | (2006.01) |
| ***C11D 3/20*** | (2006.01) |
| ***C11D 3/30*** | (2006.01) |

(52) U.S. Cl.

CPC ..... *C11D 17/0013* (2013.01); *C11D 1/22* (2013.01); *C11D 3/044* (2013.01); *C11D 3/201* (2013.01); *C11D 3/2003* (2013.01); *C11D 3/2017* (2013.01); *C11D 3/2044* (2013.01); *C11D 3/2048* (2013.01); *C11D 3/2068* (2013.01); *C11D 3/2093* (2013.01); *C11D 3/30* (2013.01); *C11D 17/003* (2013.01); *C11D 17/0026* (2013.01)

(58) Field of Classification Search

CPC ..... D06M 10/00; C11D 17/00
USPC ..... 8/115.51; 510/353, 405
See application file for complete search history.

(56) References Cited

U.S. PATENT DOCUMENTS

| | | | | |
|---|---|---|---|---|
| 2,920,045 | A | 1/1960 | Hearn et al. | |
| 7,294,611 | B2 | 11/2007 | Metrot et al. | |
| 8,940,677 | B2 | 1/2015 | Boutique et al. | |
| 8,969,281 | B2 | 3/2015 | Panandiker et al. | |
| 2004/0009882 | A1* | 1/2004 | Elsik | B01D 3/322 510/108 |
| 2004/0058845 | A1 | 3/2004 | Metrot et al. | |
| 2004/0058854 | A1* | 3/2004 | Rapin | A61K 47/48023 514/21.91 |
| 2004/0200005 | A1* | 10/2004 | Smerznak et al. | 8/115.51 |

(Continued)

OTHER PUBLICATIONS

U.S. Appl. No. 13/964,132, filed Aug. 12, 2013, Guida, et al.

(Continued)

*Primary Examiner* — Gregory R Delcotto
*Assistant Examiner* — Preeti Kumar
(74) *Attorney, Agent, or Firm* — Gregory S. Darley-Emerson; Leonard W. Lewis; Steven W. Miller

(57) ABSTRACT

The present invention relates to external structuring system(s) (ESS) comprising crystallized triglycerides including crystallized hydrogenated castor oil (HCO), surfactant and organic non-amino functional alcohols to reduce shear sensitivity. The present invention also relates to laundry detergent compositions in liquid or gel form comprising ESS.

12 Claims, 1 Drawing Sheet

(56) References Cited

U.S. PATENT DOCUMENTS

| | | | | |
|---|---|---|---|---|
| 2005/0043200 | A1* | 2/2005 | Barry | C11D 3/2075 510/421 |
| 2006/0276364 | A1* | 12/2006 | Kouvroukoglou | C11D 3/201 510/293 |
| 2011/0034366 | A1 | 2/2011 | Panandiker et al. | |
| 2011/0061174 | A1 | 3/2011 | Boutique et al. | |
| 2011/0065624 | A1 | 3/2011 | Boutique et al. | |
| 2011/0065625 | A1 | 3/2011 | Boutique et al. | |

OTHER PUBLICATIONS

EP Search Report; 7 Pages; Dated Feb. 28, 2013.
PCT Search Report for International Application No. PCTIUS2013/061418, dated Jan. 20, 2014, 12 pages.

* cited by examiner

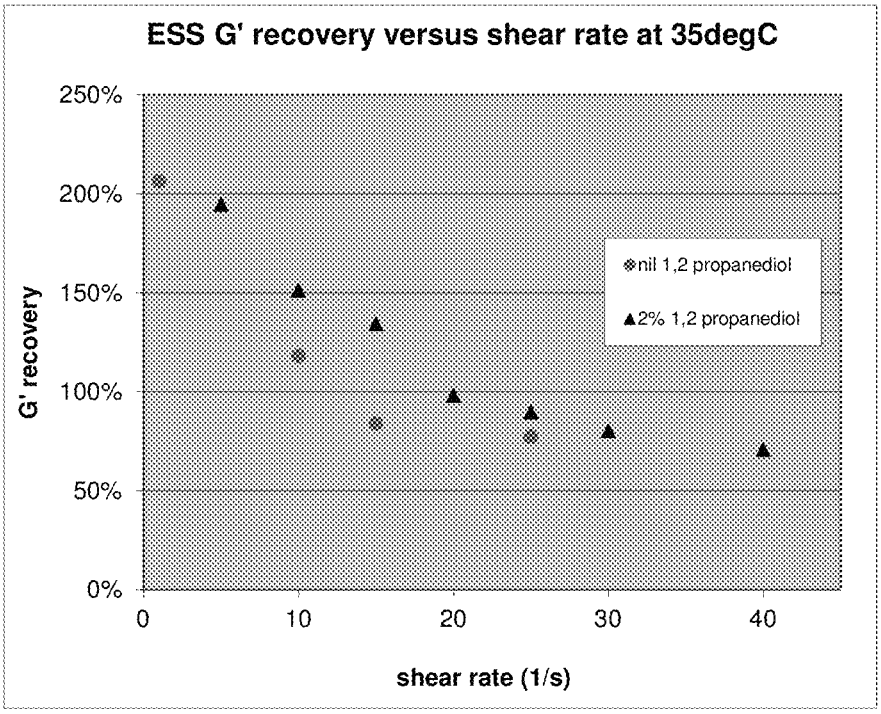
ESS G' recovery versus shear rate at 35degC
250%
200%
150%
100%
50%
0%
G' recovery
0
10
20
30
40
shear rate (1/s)
nil 1,2 propanediol
2% 1,2 propanediol

EXTERNAL STRUCTURING SYSTEM FOR LIQUID LAUNDRY DETERGENT COMPOSITION

FIELD OF THE INVENTION

The present invention relates to external structuring system(s) (ESS) comprising crystallized triglycerides including crystallized hydrogenated castor oil (HCO) and organic non-amino functional alcohols to reduce shear sensitivity. The present invention also relates to laundry detergent compositions in liquid or gel form comprising ESS.

BACKGROUND OF THE INVENTION

Liquid compositions, particularly aqueous detergent compositions comprising appreciable amounts of surfactants may be difficult to formulate, given their tendency to split into two or more phases, such as one or more surfactant-rich phases and a water-rich phase. Further technical difficulties may arise when particulate matter is to be suspended in surfactant-containing liquid compositions as the particulates may have a tendency to rise to the top or to settle to the bottom of the composition over time. Yet consumers delight in fluid detergents offering stabilized particulate materials which can deliver cleaning performance, fabric care benefits, appearance benefits, and/or visual or aesthetic cues. Crystallizable glycerides including hydrogenated castor oil (HCO, Thixcin R®, castor wax, trihydroxystearin) has been used as a rheology-modifying agent or external structurant for many years. When crystallized to fiber/thread-like crystals, HCO can stabilize liquid compositions and prevent separation from the liquid phase or prevent coagulation of liquid crystals or suspended particles.

Aqueous laundry detergent compositions which are stabilized through the use of external structuring system(s) (ESS) comprising hydroxyl-containing stabilizers have been described in the past. The ESS is added to the detergent composition to obtain desired finished product rheology and structuring. Before the ESS is blended into the finished product it is transported through pipe flow and pumps in and out of storage tanks, and therefore, the fibers of the crystallizable glycerides of ESS are subjected to shear. It is known that due to shear, fibers of the crystallizable glycerides lose part of its structuring ability, because the fibers of the crystallizable glyceride undergo irreversible aggregation and/or breakage under flow. It is estimated that 20-30% of structuring stability is lost during making process off ESS, storage, transportation and making progress of the final product. This leads to higher ESS quantities required and/or not optimal rheology/structuring in the final product.

It is thus an object of the present invention to provide ESSs suitable for detergent compositions to provide improved shear sensitivity.

It has now been discovered that the above mentioned objective can be met by using a combination of crystallizable glyceride(s), anionic surfactant and an organic non-amino functional alcohols in the ESS. Furthermore, ESS according to the present invention allows use of a lower level of crystallizable glyceride(s), whilst providing desired structuring for the final product.

SUMMARY OF THE INVENTION

The present invention relates to an external structuring system for liquid and gel-form detergents comprising by weight percentage: a) from 2% to 10% of crystals of a glyceride having a melting temperature of from 40° C. to 100° C.; b) from 2% to 20% of pH adjusting agent; c) from 5% to 50% of an anionic surfactant; and d) from greater than 1% to equal or less than 2.5% of an organic non-amino-functional alcohol selected from the group consisting of ethanol, propanol, butanol, isopropanol, 1,2-propanediol, 1,3-propanediol, diethylglycol and mixtures thereof. Furthermore, the present invention relates to a detergent composition comprising the external structuring system according to any preceding claims.

The present invention further encompasses a use of the external structuring system according to present invention in a detergent composition to reduce shear sensitivity.

BRIEF DESCRIPTION OF THE DRAWINGS

FIG. 1 shows the shear resistance of an ESS according to the present invention compared to a conventional (non organic non-aminofunctional alcohols) hydrogenated castor oil external structurant.

DETAILED DESCRIPTION OF THE INVENTION

As used herein, the term "external structuring system" or "ESS" refers to a selected compound or mixture of compounds which provides structure to a detergent composition independently from, or extrinsic from, any structuring effect of the detersive surfactants of the composition. Structuring benefits include arriving at yield stresses suitable for suspending particles having a wide range of sizes and densities. ESS of use may have chemical identities set out in detail hereinafter.

Without wishing to be bound by theory, many external structurants are believed to operate by forming solid structures having particular morphologies in the detergent composition. These solid structures may take one or more physical forms. Non-limiting examples of typical physical or morphological forms include threads, needles, ribbons, rosettes and mixtures thereof. Without wishing to be bound by theory, it is believed that thread-like, ribbon-like, spindle-like or fibril-like structuring systems, that is to say structuring systems having non-spherical elongated particles, provide the most efficient structure in liquids. Consequently, in some embodiments, thread-like, ribbon-like, spindle-like or fibril-like structuring systems are preferred. It is further believed that external structurant systems comprising crystallizable glyceridenes including CHO and organic non-aminofunctional alcohols may contain, and provide both in ESS and in detergent compositions, a more complete and shear resistance fiber network than is present in an otherwise analogous composition but without this combination. Without wishing to be bound by theory it is believed that fibers irreversible aggregation under flow is contrasted by electrostatic repulsion forces due electrical charges deposited on the fiber surface by the specific surfactant. Furthermore, when a organic non-aminofunctional alcohol is added the electrostatic forces are perceived stronger at higher distance, thus preventing better from aggregation under shear.

"Liquid" as used herein may include liquids, gels, foams, mousse, and any other flowable substantially non-gas phased composition. Non-limiting examples of fluids within the scope of this invention include light duty and heavy duty liquid detergent compositions, hard surface cleaning compositions, detergent gels commonly used for laundry, and bleach and laundry additives. Gases, e.g., suspended bubbles, may be included within the liquids.

By "internal structuring" it is meant that the detergent surfactants, which form a major class of laundering ingredients, are relied on for structuring effect. The present invention, in the opposite sense, aims at "external structuring" meaning structuring which relies on a nonsurfactant, e.g., crystallized glyceride(s) including, but not limited to, hydrogenated castor oil, to achieve the desired rheology and particle suspending power.

"Limited solubility" as used herein means that no more than nine tenths of the formulated agent actually dissolves in the liquid composition. An advantage of crystallizable glyceride(s) such as hydrogenated castor oil as an external structurant is an extremely limited water solubility.

"Soluble" as used herein means that more than nine tenths of the formulated agent actually dissolves in the liquid composition at a temperature of 20° C.

"Premix" as used herein means a mixture of ingredients designed to be mixed with other ingredients, such as the balance of a liquid or gel-form laundry detergent, before marketing. A "premix" can itself be an article of commerce, and can be sold, for example in bulk containers, for later mixing with the balance of a laundry detergent at a remote location. One the other hand some premixes may directly be used for arriving at a complete detergent composition made in a single facility.

"Emulsion" as used herein, unless otherwise specifically indicated, refers to macroscopic droplets, which are large enough to be seen using conventional optical microscopy, of hydrogenated castor oil and/or another triglyceride, in the structurant premix (ESS). The emulsion can involve liquid droplets or can involve solidified droplets, depending on the temperature. Hydrogenated castor oil is soluble to a limited extent in the alkanolamine neutralized anionic surfactant containing premix, and as a result, microemulsions may also be present.

"Aspect ratio" as defined herein means the ratio of the largest dimension of a particle (l) to the smallest dimension of a particle (w), expressed as "l:w". An aspect ratio may for example characterize a structurant crystal particle of crystallizable glyceride(s) such as hydrogenated castor oil. The aspect ratio of dispersions can be adequately characterized by TEM (transmission electron microscopy) or similar techniques, e.g., cryo-ESEM. In using such techniques in the present invention, the intent is to examine crystals of the hydrogenated castor oil, or, more generally, any equivalently crystallizable glyceride; hence it is preferred to conduct measurements with a minimum of artifact creation. Artifacts can be created, for example, by evaporating solvent from the ESS so that surfactant crystals precipitate—these are not crystals of glyceride(s) such as hydrogenated castor oil for example. A high aspect ratio is desirable for the hydrogenated castor oil in the external structurants for use herein. Preferably the aspect ratio of crystals of hydrogenated castor oil in ESS and/or in detergents comprising is greater than 1:1, in other words the structurant crystals are elongated. In a preferred embodiment, the aspect ratio is at least 5:1. In a preferred embodiment the aspect ratio is from 5:1 to about 200:1, preferably from about 10:1 to about 100:1. In typical cases, the aspect ratio can be from 10:1 to 50:1. Aggregation or breakage of the crystals reduces the aspect ratio, is not preferred.

"Rosette" as defined herein means a particle of crystallized structurant, e.g., of a crystals of glyceride such as hydrogenated castor oil for example, having a rosette-like appearance. Such particles can be readily seen by use of differential interference contrast microscopy, or other visual microscopy techniques. Rosettes can have an approximate diameter of 1-50 microns, more typically 2 to 20 microns, e.g., about 5 microns. Preferred ESS herein can be free from rosettes. Other preferred ESS herein may have a low proportion of rosettes to needle-like crystals. Without intending to be limited by theory, reducing the proportion of rosettes to needles improves the mass efficiency of the ESS.

All percentages, ratios and proportions used herein are by weight percent of the composition, unless otherwise specified. All average values are calculated "by weight" of the composition or components thereof, unless otherwise expressly indicated.

External Structuring System

The ESS of the present invention comprise: (a) crystallizable glyceride(s); (b) pH adjusting agent; (c) anionic surfactant; (d) organic non-aminofunctional alcohols (e) additional components; and (f) optional components. Each of these components is discussed in detail below.

(a) Crystallizable Glyceride(s)

A crystallizable glyceride(s) of use herein include "Hydrogenated castor oil" or "HCO" and is an essential component the ESS of the present invention. HCO as used herein most generally can be any hydrogenated castor oil, provided that it is capable of crystallizing in the ESS premix. Castor oils may include glycerides, especially triglycerides, comprising $C_{10}$ to $C_{22}$ alkyl or alkenyl moieties which incorporate a hydroxyl group. Hydrogenation of castor oil to make HCO converts double bonds, which may be present in the starting oil as ricinoleyl moieties, to convert ricinoleyl moieties to saturated hydroxyalkyl moieties, e.g., hydroxystearyl. The HCO herein may, in some embodiments, be selected from: trihydroxystearin; dihydroxystearin; and mixtures thereof. The HCO may be processed in any suitable starting form, including, but not limited those selected from solid, molten and mixtures thereof. HCO is typically present in the ESS of the present invention at a level of from 2% to 10%, from 3% to 8%, or from 4% to 6% by weight of the structuring system. In some embodiments, the corresponding percentage of hydrogenated castor oil delivered into a finished laundry detergent product is below 1.0%, typically from 0.1% to 0.8%.

Useful HCO may have the following characteristics: a melting point of from 40° C. to 100° C., preferably from 65° C. to 95° C.; and/or Iodine value ranges of from 0 to 5, preferably from 0 to 4, and most preferably from 0 to 2.6. The melting point of HCO can measured using either ASTM D3418 or ISO 11357; both tests utilize DSC: Differential Scanning Calorimetry. HCO of use in the present invention includes those that are commercially available. Non-limiting examples of commercially available HCO of use in the present invention include: THIXCIN® from Rheox, Inc. Further examples of useful HCO may be found in U.S. Pat. No. 5,340,390. The source of the castor oil for hydrogenation to form HCO can be of any suitable origin, such as from Brazil or India. In one suitable embodiment, castor oil is hydrogenated using a precious metal, e.g., palladium catalyst, and the hydrogenation temperature and pressure are controlled to optimize hydrogenation of the double bonds of the native castor oil while avoiding unacceptable levels of dehydroxylation.

The invention is not intended to be directed only to the use of hydrogenated castor oil. Any other suitable crystallizable glyceride(s) may be used. In one example, the structurant is substantially pure triglyceride of 12-hydroxystearic acid. This molecule represents the pure form of a fully hydrogenated triglyceride of 12-hydrox-9-cis-octadecenoic acid. In nature, the composition of castor oil is rather constant, but may vary somewhat. Likewise hydrogenation procedures may vary. Any other suitable equivalent materials, such as mixtures of triglycerides wherein at least 80% wt. is from castor oil, may be used. Exemplary equivalent materials comprise primarily, or consist essentially of, triglycerides; or comprise primarily, or consist essentially of, mixtures of diglycerides and triglycerides; or comprise primarily, or consist essentially of, mixtures of triglyerides with diglycerides and limited amounts, e.g., less than about 20% wt. of the glyceride mixtures, of monoglyerides; or comprise primarily, or consist essentially of, any of the foregoing glycerides with limited amounts, e.g., less than about 20% wt., of the corresponding acid hydrolysis product of any of said glycerides. A proviso in the above is that the major proportion, typically at least 80% wt, of any of said glycerides is chemically identical to glyceride of fully hydrogenated ricinoleic acid, i.e., glyceride of 12-hydroxystearic acid. It is for example well known in the art to modify hydrogenated castor oil such that in a given triglyceride, there will be two 12-hydroxystearic-moieties and one stearic moiety. Likewise it is envisioned that the hydrogenated castor oil may not be fully hydrogenated. In contrast, the invention excludes poly(oxyalkylated) castor oils when these fail the melting criteria.

(b) pH Adjusting Agent

A pH adjusting agent is an essential component the ESS of the present invention. Compositions of the present invention comprise one or more pH-adjusting agents. The pH-adjusting agent is typically present at concentrations from 2% to 20%, preferably from 22% to 10%, more preferably from 0.3% to 5.0% by weight of the structuring system.

In general any known pH-adjusting agents are useful herein, including alkalinity sources as well as acidifying agents of either inorganic type and organic type.

Inorganic alkalinity sources include but are not limited to, water-soluble alkali metal hydroxides, oxides, carbonates, bicarbonates, borates, silicates, metasilicates, and mixtures thereof; water-soluble alkali earth metal hydroxides, oxides, carbonates, bicarbonates, borates, silicates, metasilicates, and mixtures thereof; water-soluble boron group metal hydroxides, oxides, carbonates, bicarbonates, borates, silicates, metasilicates, and mixtures thereof; and mixtures thereof. Preferred inorganic alkalinity sources are sodium hydroxide, and potassium hydroxide and mixtures thereof, most preferably inorganic alkalinity source is sodium hydroxide. Although not preferred for ecological reasons, water-soluble phosphate salts may be utilized as alkalinity sources, including pyrophosphates, orthophosphates, polyphosphates, phosphonates, and mixtures thereof.

Organic alkalinity sources include but are not limited to, primary, secondary, tertiary amines, and mixtures thereof.

Other organic alkalinity sources are alkanolamine or mixture of alkanolamines. Suitable alkanolamines may be selected from the lower alkanol mono-, di-, and trialkanolamines, such as monoethanolamine; diethanolamine or triethanolamine. Higher alkanolamines have higher molecular weight and may be less mass efficient for the present purposes. Mono- and di-alkanolamines are preferred for mass efficiency reasons. Monoethanolamine is particularly preferred, however an additional alkanolamine, such as triethanolamine, can be useful in certain embodiments as a buffer. Most preferred alkanolamine used herein is monoethanol amine.

Inorganic acidifying agents include but are not limited to, HF, HCl, HBr, HI, boric acid, phosphoric acid, phosphonic acid, sulphuric acid, sulphonic acid, and mixtures thereof. Preferred inorganic acidifying agent is boric acid.

Organic acidifying agents include but are not limited to, substituted and substituted, branched, linear and/or cyclic $C_1$ to $C_{30}$ carboxyl acids, and mixtures thereof.

(c) Anionic Surfactant

An anionic surfactant is an essential component the ESS of the present invention. Without wishing to be bound by theory, it is believed that the anionic surfactant acts as an emulsifier of melts of HCO and similarly crystallizable glycerides. In the context of the external structuring system only (as opposed to in the context of a liquid detergent composition comprising a surfactant system), the following is true. As used herein "anionic surfactant" in preferred embodiments does not include soaps and fatty acids; they may be present in the final laundry detergent compositions, but in general, other than limited amounts of 12-hydroxystearic acid which may arise from limited hydrolysis of hydrogenated castor oil glycerides, are not deliberately included in the ESS. For overall formula accounting purposes, "soaps" and "fatty acids" are accounted as builders. Otherwise, any suitable anionic surfactant is of use in the ESS of present invention.

Suitable anionic surfactants useful herein can comprise any of the conventional anionic surfactant types typically used in liquid products. These include the alkyl sulfonic acids, alkyl benzene sulfonic acids, ethoxylated alkyl sulfates and their salts as well as alkoxylated or un-alkoxylated alkyl sulfate materials.

Non-limiting examples of suitable anionic surfactants of use herein include: Linear Alkyl Benzene Sulphonate (LAS), Alkyl Sulphates (AS), Alkyl Ethoxylated Sulphonates (AES), Laureth Sulfates and mixtures thereof, most preferred anionic surfactant is liner alkyl benzene sulphonate (LAS). In some embodiments, the anionic surfactant may be present in the external structuring system at a level of from 5% to 50%. However, when more than 25% by weight of the ESS of an anionic surfactant is used, it is typically required to thin the surfactant using an organic solvent in addition to water.

Preferred anionic surfactants are the alkali metal salts of $C_{10-16}$ alkyl benzene sulfonic acids, preferably $C_{11-14}$ alkyl benzene sulfonic acids. Preferably the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383. Preferred are the sodium and potassium linear alkylbenzene sulfonates in which the average number of carbon atoms in the alkyl group is from about 11 to 14. Most preferred are the acidic form of linear alkylbenzene sulfonates (HLAS) in which the average number of carbon atoms in the alkyl group is from about 11 to 14. $C_{11}$-$C_{14}$, e.g., $C_{12}$ HLAS is most preferred.

Another preferred type of anionic surfactant comprises ethoxylated alkyl sulfate surfactants. Such materials, also known as alkyl ether sulfates or alkyl polyethoxylate sulfates, are those which correspond to the formula:

$$R'—O—(C_2H_4O)_n—SO_3M$$

wherein R' is a $C_8$-$C_{20}$ alkyl group, n is from about 1 to 20, and M is a salt-forming cation. Preferably, R' is $C_{10}$-$C_{18}$ alkyl, n is from about 1 to 15, and M is sodium, potassium, ammonium, alkylammonium, or alkanolammonium. Most preferably, R' is a $C_{12}$-$C_{16}$, n is from about 1 to 6 and M is sodium.

The alkyl ether sulfates will generally be used in the form of mixtures comprising varying R' chain lengths and varying degrees of ethoxylation. Frequently such mixtures will inevitably also contain some unethoxylated alkyl sulfate materials, i.e., surfactants of the above ethoxylated alkyl sulfate formula wherein n=0. Unethoxylated alkyl sulfates may also be added separately to the compositions of this invention and used as or in any anionic surfactant component which may be present.

Preferred unalkoyxylated, e.g., unethoxylated, alkyl ether sulfate surfactants are those produced by the sulfation of higher $C_8$-$C_{20}$ fatty alcohols. Conventional primary alkyl sulfate surfactants have the general formula:

$$ROSO_3^-M^+$$

wherein R is typically a linear $C_8$-$C_{20}$ hydrocarbyl group, which may be straight chain or branched chain, and M is a water-solubilizing cation. Preferably R is a $C_{10}$-$C_{15}$ alkyl, and M is alkali metal. Most preferably R is $C_{12}$-$C_{14}$ and M is sodium.

(d) Organic Non-Aminofunctional Alcohols

An organic non-aminofunctional alcohol(s) is essential component of ESS of the present invention. Organic non-aminofunctional alcohols are typically consisting essentially of C, H and O (i.e., non-silicones and heteroatom-free) are present in the ESS to improve the shear resistance especially during processing in combination with CHO.

Thus organic non-aminofunctional organic alcohols are present when preparing the ESS premixes. Preferred organic non-aminofunctional alcohols include monohydric alcohols, dihydric alcohols, polyhydric alcohols, glycerol, glycols and mixtures thereof. Highly preferred are mixtures of solvents, especially mixtures of lower aliphatic alcohols such as ethanol, propanol, butanol, isopropanol, and/or diols such as 1,2-propanediol or 1,3-propanediol; diethylene glycol, and mixtures thereof. Suitable alcohols especially include a C1-C4 alcohols. Preferably the organic non-aminofunctional alcohol is 1,2-propanediol or 1,3-propanediol, most preferably the organic non-aminofunctional alcohol is 1,2-propanediol. In the ESS, organic non-aminofunctional alcohol is present at levels of greater than 1% to equal or less than 2.5% by weight of the ESS, more preferably at levels of greater than 1% to equal or less than 2% and most preferably organic non-aminofunctional alcohol is present at levels of equal or less than 2% by weight of the ESS.

(e) Additional Components

Additional Surfactant

The ESS of the present invention may optionally contain surfactant in addition to anionic surfactants. In some embodiments, the systems may further comprise surfactant selected from: nonionic surfactant; cationic surfactant; amphoteric surfactant; zwitterionic surfactant; and mixtures thereof.

Buffer

The ESS of the invention may optionally contain a pH buffer. In some embodiments, the pH is maintained within the pH range of from 5 to 11, or from 6 to 9.5, or from 7 to 9. Without wishing to be bound by theory, it is believed that the buffer stabilizes the pH of the ESS thereby limiting any potential hydrolysis of the HCO structurant. However, buffer-free embodiments can be contemplated and when HCO hydrolyses, some 12-hydroxystearate may be formed, which has been described in the art as being capable of structuring. In certain preferred buffer-containing embodiments, the pH buffer does not introduce monovalent inorganic cations, such as sodium, in the structuring system. In some embodiments, the preferred buffer is the monethanolamine salt of boric acid. However embodiments are also contemplated in which the buffer is sodium-free and boron-free; or is free from any deliberately added sodium, boron or phosphorus. In some embodiments, the MEA neutralized boric acid may be present at a level of from 0% to 5%, from 0.5% to 3%, or from 0.75% to 1% by weight of the structuring system.

As already noted, alkanolamines such as triethanolamine and/or other amines can be used as buffers; provided that alkanolamine is first provided in an amount sufficient for the primary structurant emulsifying purpose of neutralizing the acid form of anionic surfactants.

Water

The ESS of the present invention may contain water. Water may form the balance of the present structuring systems after the weight percentage of all of the other ingredients are taken into account.

In some embodiments, the water may be present at a level of from 5% to 90% by weight of the external structuring system, preferably from 10% to 80%, more preferably from 15% to 78% and most preferably from 30% to 78%.

(f) Optional Components

Preservative

Preservatives such as soluble preservatives may be added to the ESS or to the final detergent product so as to limit contamination by microorganisms. Such contamination can lead to colonies of bacteria and fungi capable of resulting in phase separation, unpleasant, e.g., rancid odors and the like. The use of a broad-spectrum preservative, which controls the growth of bacteria and fungi is preferred. Limited-spectrum preservatives, which are only effective on a single group of microorganisms may also be used, either in combination with a broad-spectrum material or in a "package" of limited-spectrum preservatives with additive activities. Depending on the circumstances of manufacturing and consumer use, it may also be desirable to use more than one broad-spectrum preservative to minimize the effects of any potential contamination.

The use of both biocidal materials, i.e. substances that kill or destroy bacteria and fungi, and biostatic preservatives, i.e. substances that regulate or retard the growth of microorganisms, may be indicated for this invention.

Typically, preservatives will be used only at an effective amount. For the purposes of this disclosure, the term "effective amount" means a level sufficient to control microbial growth in the product for a specified period of time, i.e., two weeks, such that the stability and physical properties of it are not negatively affected. For most preservatives, an effective amount will be between 0.00001% and 0.5% of the total formula, based on weight. Obviously, however, the effective level will vary based on the material used, and one skilled in the art should be able to select an appropriate preservative and use level.

Preferred preservatives for the compositions of this invention include organic sulphur compounds, halogenated materials, cyclic organic nitrogen compounds, low molecular weight aldehydes, quaternary ammonium materials, dehydroacetic acid, phenyl and phenoxy compounds and mixtures thereof.

Examples of preferred preservatives for use in the compositions of the present invention include: a mixture of 77% 5-chloro-2-methyl-4-isothiazolin-3-one and 23% 2-methyl-4-isothiazolin-3-one, which is sold commercially as a 1.5% aqueous solution by Rohm & Haas (Philadelphia, Pa.) under the trade name Kathon; 1,2-benzisothiazolin-3-one, which is sold commercially by Avecia (Wilmington, Del.) as, for example, a 20% solution in dipropylene glycol sold under the trade name Proxel™ GXL sold by Arch Chemicals (Atlanta, Ga.); and a 95:5 mixture of 1,3 bis(hydroxymethyl)-5,5-dimethyl-2,4 imidazolidinedione and 3-butyl-2-iodopropynyl carbamate, which can be obtained, for example, as Glydant Plus from Lonza (Fair Lawn, N.J.). A highly preferred preservative system is sold commercially as Acticide™ MBS and comprises the actives methyl-4-isothiazoline (MIT) and 1,2-benzisothizolin-3-one (BIT) in approximately equal proportions by weight and at a total concentration in the Acticide™ MBS of 5%. The Acticide is formulated at levels of 0.001 to 0.1%, more typically 0.01 to 0.1% by weight on a 100% active basis in the ESS premix.

Other Thickeners

Polymeric thickeners known in the art, e.g., Carbopol™ from Lubrizol (Wickliffe, Ohio), acrylate copolymers such as those known as associative thickeners and the like may be used to supplement the ESS. These materials may be added either in the ESS premix, or separately into the final detergent composition. Additionally or alternatively known LMOG (low molecular weight organogellants) such as dibenzylidene sorbitol may be added to the compositions either in the ESS premix, or in the final detergent compositions. Suitable use levels are from 0.01% to 5%, or from 0.1 to 1% by weight of the final detergent composition.

Particulate Material

Either the ESS or the final detergent composition may further include particulate material such as suds suppressors, encapsulated sensitive ingredients, e.g., perfumes, bleaches and enzymes in encapsulated form; or aesthetic adjuncts such as pearlescent agents, pigment particles, mica or the like. Suitable use levels are from 0.0001% to 5%, or from 0.1% to 1% by weight of the final detergent composition. In embodiments of the invention it is found useful to incorporate certain particulate materials, e.g., mica for visual appearance benefits, directly into the ESS while formulating more sensitive particulate materials, e.g., encapsulated enzymes and/or bleaches, at a later point into the final detergent composition.

Method of Making External Structuring System

ESS of the present invention may be made using a method comprising the steps of: (a) preparing a first premix generally containing anionic surfactant and solution e.g., water and organic non-aminofunctional alcohols and alkanolamines; (b) forming a hot premix with inclusion of crystallizable glyceride(s) in the premix at a temperature of from 50° C. to 150° C.; (c) at least partially cooling or allowing to cool the product of steps (a) and (b) to provide the external structuring system (ESS) of the invention; and (d) optionally, adding a preservative to the external structuring system. These steps may be completed in the following order: "a" through "d". However, it is noted that variations which result in thread-like ESS are also meant to be encompassed within the present invention, for example preservative may be included in step (a) rather than as a separate step (d). Once the ESS has been prepared, it may added to the balance of the detergent composition, typically with a temperature difference of no more than 20° C. to 30° C. between the ESS and the balance of the detergent composition; preferably the ESS and balance of the detergent are combined in the cold.

More detailed description of each preparation step (preparing a premix; emulsifying the HCO; cooling the premix and addition of preservative) can be found in WO 2011/031940, pages 17-18.

General Shear Conditions

As has already been pointed out, the ESS herein can be manufactured using a range of equipment types and shear regimes. In one preferred embodiment, the process employs a relatively low shear regime, in which shear rates reach a maximum of from 100 to 500 $s^{-1}$, and the ESS experiences this shear maximum for a residence time under the highest shear condition of no more than 60 to 100 seconds (s). In practical terms, one process employs batch, pipe, pump and plate heat exchanger devices, and the maximum shear occurs in the plate heat exchanger stage used to cool the ESS; but the ESS passes quite seldom through this high shear area, for example only from about three to about five passes per production run.

Detergent Compositions

The ESS of the present invention may be incorporated into a detergent composition or components thereof as described below. The detergent composition can take any suitable form and may be selected from liquid laundry detergent, unit dose detergent and/or hard surface cleaning compositions.

Method of Incorporating the External Structuring System

Any suitable means of incorporating the ESS of the present invention into a detergent composition or components thereof may be utilized. One of skill in the art is capable of determining at what point in the detergent manufacturing process that the ESS should be incorporated. Since ESS of the present invention may be shear sensitive, it may be desirable in some embodiments to add the ESS to the detergent composition or components of thereof as late in the manufacturing process as possible. However, in some embodiments, it may be desirable to add the ESS earlier in the manufacturing process to stabilize any non-homogeneity prior to finishing the detergent in a late product differentiation process. Thus in some embodiments, the systems may be added via a continuous liquid process, whereas in other embodiments, the systems may be added via late product differentiation.

When incorporating ESS that are shear sensitive into other components to form a detergent composition, it may be advantageous to set certain operating parameters. For example, in some embodiments, the average shear rate utilized to incorporate the ESS may be from 300 $s^{-1}$ to 500 $s^{-1}$, from 100 $s^{-1}$ to 5000 $s^{-1}$, or from 0.01 $s^{-1}$ to 10000 $s^{-1}$. Instantaneous shear may be as high as from 3000 $s^{-1}$ to 5000 $s^{-1}$ for a short period of time. To define the rheology profile, a TA550 Rheometer, available from TA Instruments, is used to determine the flow curve of the compositions. The determination is performed at 20° C. with a 4 cm flat plate measuring system set with a 500 micron gap. The determination is performed via programmed application of a shear rate continuous ramp (typically 0.05 $s^{-1}$ to 30 $s^{-1}$) over a period of time (3 minutes). These data are used to create a viscosity versus shear rate flow curve.

The time needed to incorporate ESS into other components to form a detergent composition may be from about from 1 s to 120 s, from 0.5 s to 1200 s or from 0.001 s to 12000 s.

Liquid Laundry Detergent Compositions

In some embodiments, the present invention is directed to liquid laundry detergent compositions comprising the ESS of the present invention. The liquid laundry detergent compositions may be in any suitable form and may comprise any suitable components. Non-limiting examples of suitable components are described in turn below.

Surfactant Component

The detergent compositions herein comprise from 1% to 70% by weight of a surfactant component selected from anionic, nonionic, cationic, zwitterionic and/or amphoteric surface active agents. More preferably, the surfactant component will comprise from 5% to 45% by weight of the composition and will comprise anionic surfactants, nonionic surfactants and combinations thereof.

Anionic Surfactants

Suitable anionic surfactants useful herein can comprise any of the conventional anionic surfactant types typically used in liquid detergent products. These include the alkyl benzene sulfonic acids and their salts as well as alkoxylated or un-alkoxylated alkyl sulfate materials. Preferred anionic surfactants for use herein have been described in WO 2011/0319940, pages 20-21.

Nonionic Surfactants

Suitable nonionic surfactants useful herein can comprise any of the conventional nonionic surfactant types typically used in liquid detergent products. These include alkoxylated fatty alcohols and amine oxide surfactants. Preferred for use in the liquid detergent products herein are those nonionic surfactants which are normally liquid. Preferred nonionic surfactants for use herein have been described in WO 2011/0319940, pages 21-22.

Anionic/Nonionic Surfactant Combinations

In the liquid detergent compositions herein, the detersive surfactant component may comprise combinations of anionic and nonionic surfactant materials.

Aqueous Liquid Carrier

Generally the amount of the aqueous, non-surface active liquid carrier employed in the compositions herein will be relatively large. For example, the non-aqueous, non-surface active liquid carrier component can comprise from 0% to 40% by weight of the compositions herein. More preferably this liquid carrier component will comprise from 1% to 30%, and even more preferably from 2% to 25% by weight of the compositions herein.

The most cost effective type of aqueous, non-surface active liquid carrier is, of course, water itself. Accordingly, the aqueous, non-surface active liquid carrier component will generally be mostly, if not completely, comprised of water. While other types of water-miscible liquids, such alkanols, diols, other polyols, ethers, amines, and the like, have been conventionally been added to liquid detergent compositions as co-solvents or stabilizers, for purposes of the present invention, the utilization of such water-miscible liquids should be minimized to hold down composition cost. Accordingly, the aqueous liquid carrier component of the liquid detergent products herein will generally comprise water present in concentrations ranging from 0% to 90%, more preferably from 5% to 70%, by weight of the composition.

Optional Detergent Composition Ingredients

The detergent compositions of the present invention can also include any number of additional optional ingredients. These include conventional laundry detergent composition components such as detersive builders, enzymes, enzyme stabilizers (such as propylene glycol, boric acid and/or borax), suds suppressors, soil suspending agents, soil release agents, other fabric care benefit agents, pH adjusting agents, chelating agents, smectite clays, solvents, hydrotropes and phase stabilizers, structuring agents, dye transfer inhibiting agents, optical brighteners, perfumes and coloring agents. The various optional detergent composition ingredients, if present in the compositions herein, should be utilized at concentrations conventionally employed to bring about their desired contribution to the composition or the laundering operation. Frequently, the total amount of such optional detergent composition ingredients can range from 2% to 50%, more preferably from 5% to 30%, by weight of the composition. A few of the optional ingredients which can be used have been described in greater detail in WO 2011/031940: organic detergent builders, pages 23-24; detersive enzymes, page 24; solvents, hydrotropes and phase stabilizers, page 24; and pH control agents, page 24.

Unit Dose Detergent

In some embodiments of the present invention, the liquid detergent compositions are packaged in a unit dose pouch, wherein the pouch is made of a water soluble film material, such as a polyvinyl alcohol. In some embodiments, the unit dose pouch comprises a single or multi-compartment pouch where the present liquid detergent composition can be used in conjunction with any other conventional powder or liquid detergent composition. Examples of suitable pouches and water soluble film materials are provided in U.S. Pat. Nos. 6,881,713, 6,815,410, and 7,125,828. Conventional processes for making of unit dose pouches are vertical form fill seal (VFFS) and horizontal form fill seal (HFFS), preferably HFFS with thermo and/or vacuum formin.

Hard Surface Cleaning Compositions

In some embodiments, the ESS may be utilized in liquid hard surface cleaning compositions. Such compositions include, but are not limited to, forms selected from gels, pastes, thickened liquid compositions as well as compositions having a water-like viscosity. A preferred liquid hard surface cleaning composition herein is an aqueous, liquid hard surface cleaning composition and therefore, preferably comprises water more preferably in an amount of from 50% to 98%, even more preferably of from 75% to 97% and most preferably 80% to 97% by weight of the total composition.

Examples

Referencing Tables I-III below, are non-limiting examples disclosed therein include those that are illustrative of several embodiments of the invention as well as those that are comparative.

TABLE I

ESS according to the present invention:

| Ingredient | Example A % | Example B % | Example C % | Example D (comparative) % |
|---|---|---|---|---|
| Softened water | 75.55 | 75.1 | 74.6 | 76.6 |
| MEA | 3.2 | 3.2 | 3.2 | 3.2 |
| HLAS | 16 | 16 | 16 | 16 |
| HCO | 4 | 4 | 4 | 4 |
| 1,2 propane-diol | 1.05 | 1.5 | 2 | — |
| Acticide | 0.2 | 0.2 | 0.2 | 0.2 |

TABLE II

Liquid Detergent Compositions comprising ESS according to the present invention

Liquid Detergent Compositions

| Ingredient | Example 1 % | Example 2 % |
|---|---|---|
| Linear Alkylbenzene sulfonic acid[1] | 7.5 | 10.5 |
| C12-14 alkyl ethoxy 3 sulfate Na salt | 2.6 | |
| C12-14 alkyl ethoxy 3 sulfate MEA salt | | 8.5 |
| C12-14 alkyl 7-ethoxylate | 0.4 | 7.6 |
| C14-15 alkyl 7-ethoxylate | 4.4 | |
| C12-18 Fatty acid | 3.1 | 8 |
| Sodium Cumene sulfonate | 0.9 | |
| Citric acid | 3.2 | 2.8 |
| Ethoxysulfated Hexamethylene Diamine Dimethyl Quat | 1 | 2.1 |

TABLE II-continued

Liquid Detergent Compositions comprising ESS according to the present invention
Liquid Detergent Compositions

| Ingredient | Example 1 % | Example 2 % |
|---|---|---|
| Soil Suspending Alkoxylated Polyalkylenimine Polymer[2] | 0.4 | |
| PEG-PVAc Polymer[3] | 0.5 | 0.8 |
| Di Ethylene Triamine Penta (Methylene Phosphonic acid, Na salt) | 0.3 | |
| Hydroxyethane diphosphonic acid | | 1.5 |
| Fluorescent Whitening Agent | 0.1 | 0.3 |
| 1,2 Propanediol | 3.9 | 7.5 |
| Diethylene Glycol | | 3.5 |
| Sodium Formate | 0.4 | 0.4 |
| Hydrogenated castor oil derivative structurant | 0.38 | 0.75 |
| Perfume | 0.9 | 1.7 |
| Sodium Hydroxide | To pH 8.4 | |
| Monoethanolamine | 0.3 | To pH 8.1 |
| Protease enzyme | 0.4 | 0.7 |
| Amylase enzyme | | 0.7 |
| Mannanase enzyme | 0.1 | 0.2 |
| Xyloglucanase enzyme | | 0.1 |
| Pectate lyase | 0.1 | |
| Water and minors (antifoam, aesthetics, . . .) | To 100 parts | |

[1]Weight percentage of Linear Alkylbenzene sulfonic acid includes that which added to the composition via the premix
[2]600 g/mol molecular weight polyethylenimine core with 20 ethoxylate groups per —NH.
[3]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.

TABLE III unit dose detergent compositions comprising ESS according to the present invention.

| Ingredient | Example 3 % | Example 4 % | Example 5 % |
|---|---|---|---|
| Linear Alkylbenzene sulfonic acid[1] | 15 | 17 | 19 |
| C12-14 alkyl ethoxy 3 sulfonic acid | 7 | 8 | — |
| C12-15 alkyl ethoxy 2 sulfonic acid | — | — | 9 |
| C14-15 alkyl 7-ethoxylate | — | 14 | — |
| C12-14 alkyl 7-ethoxylate | 12 | — | — |
| C12-14 alkyl-9-ethoxylate | — | — | 15 |
| C12-18 Fatty acid | 15 | 17 | 5 |
| Citric acid | 0.7 | 0.5 | 0.8 |
| Polydimethylsilicone | — | 3 | — |
| Soil Suspending Alkoxylated Polyalkylenimine Polymer[2] | 4 | — | 7 |
| Hydroxyethane diphosphonic acid | 1.2 | — | — |
| Diethylenetriamine Pentaacetic acid | — | — | 0.6 |
| Ethylenediaminediscuccinic acid | — | — | 0.6 |
| Fluorescent Whitening Agent | 0.2 | 0.4 | 0.2 |
| 1,2 Propanediol | 16 | 12 | 14 |
| Glycerol | 6 | 8 | 5 |
| Diethyleneglycol | — | — | 2 |
| Hydrogenated castor oil derivative structurant | 0.15 | 0.25 | 0.1 |
| Perfume | 2.0 | 1.5 | 1.7 |
| Perfume microcapsule | — | 0.5 | — |
| Monoethanolamine | Up to pH 8 | Up to pH 8 | Up to pH 8 |
| Protease enzyme | 0.05 | 0.075 | 0.12 |
| Amylase enzyme | 0.005 | — | 0.01 |
| Mannanase enzyme | 0.01 | — | 0.005 |
| xyloglucanase | — | — | 0.005 |

TABLE III-continued unit dose detergent compositions comprising ESS according to the present invention.

| Ingredient | Example 3 % | Example 4 % | Example 5 % |
|---|---|---|---|
| Water and minors (antifoam, aesthetics, stabilizers etc.) | To 100 parts | To 100 parts | To 100 parts |

[1]Weight percentage of Linear Alkylbenzene sulfonic acid includes that which added to the composition via the premix
[2]600 g/mol molecular weight polyethylenimine core with 20 ethoxylate groups per —NH.

Comparative Data

The FIG. 1 relate to shear resistance of an ESS (C) according to the present invention compared to a conventional (non organic non-aminofunctional alcohols) hydrogenated castor oil external structurant (D).

FIG. 1 illustrates that by addition of organic non-aminofunctional alcohol (1,2 propanediol) into the EES makes it less shear sensitive. Levels of from greater than 1% to 2% of organic non-aminofunctional alcohol proved to shift up the shear rate threshold at which shear damage starts to occur. The shear rate threshold increased gradually with the level of 1,2 propanediol.

In the FIG. 1 G' recovery has been plotted after 60 seconds of shear at the shear rate specified in the x-axis. The G' recovery is the ratio of elastic modulus before and after the shear rate applied. The test is done with an ARG2 rheometer with CP geometry, at 35° C. Note that: the shear rate threshold has been defined as the shear rate at which the G' recovery after shear becomes less than 100%. The raw material viscosity and G' is a measure of how good ESS will structure finished product. Furthermore, the test below is at 35° C. The shear rate threshold is dependent on the sample temperature. When the test is done at 20° C. less shear damage will be observed. However, 35° C. is chosen as this is the temperature at which the premix is stored, transported and incorporated into finished product.

FIG. 1 shows that for the reference ESS the shear rate threshold at which can be seen that see G' not recovering 100% is between 10 and 15/s. Wherein, for the ESS according to the present invention with 2% 1,2 propanediol this is 20/s.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An external structuring system for liquid and gel-form detergents comprising by weight percentage of the external structuring system:

a) from about 2% to about 10% of crystals of a glyceride having a melting temperature of from about 40° C. to about 100° C.;

b) from about 2% to about 20% of pH adjusting agent, wherein said pH adjusting agent is monoethanolamine;

c) from about 5% to about 50% of an anionic surfactant; and d) 1% of an organic non-aminofunctional alcohol selected from the group consisting of 1,2-propanediol, 1,3-propanediol, and mixtures thereof.

2. The external structuring system according to claim 1, wherein said glyceride is hydrogenated castor oil.

3. The external structuring system according to claim 1, wherein said anionic surfactant is a synthetic anionic surfactant selected from the group consisting of sodium linear alkylbenzene sulfonates, potassium linear alkylbenzene sulfonates, and acidic form of linear alkylbenzene sulfonates (HLAS), in which the average number of carbon atoms in the alkyl group is from about 11 to about 14.

4. The external structuring system according to claim 1, wherein said anionic surfactant is acid form of linear alkylbenzenesulfonate (HLAS) in which the average number of carbon atoms in the alkyl group is from about 11 to about 14.

5. The external structuring system according to claim 1, wherein said organic non-aminofunctional alcohol is 1,2-propanediol.

6. A detergent composition comprising the external structuring system according to claim 1.

7. The detergent composition of claim 6, wherein said detergent composition is in a form selected from liquid and gel.

8. The detergent composition of claim 6, wherein said detergent is a liquid laundry detergent comprising from about 1% to about 20% external structuring system by weight of the liquid laundry detergent composition, and wherein said external structuring system provides sufficient hydrogenated castor oil to achieve a finished detergent product level of from about 0.1 to about 10 by weight % of the finished detergent product of hydrogenated castor oil.

9. The detergent composition of claim 6, wherein said detergent composition is a liquid enclosed in water-soluble film.

10. The detergent composition of claim 6, wherein said detergent is a detergent selected from a hard surface cleaning composition and a liquid laundry detergent composition.

11. A liquid detergent composition comprising an external structuring system according to claim 1, further characterized in that said detergent composition comprises, by weight % of the detergent composition:

a. from about 15 to about 40% anionic surfactant;

b. from about 5 to about 15% nonionic surfactant;

c. from about 5 to about 15% fatty acid;

d. from about 0.1 to about 5% citric acid, chelants or mixtures thereof;

e. from about 2 to about 15% organic solvent;

f. from about 0.05 to about 1.5% hydrogenated castor oil;

g. from about 5 to about 15% alkanolamine; and h. from about 0.1 to about 5% cleaning polymer.

12. A method of structuring a detergent composition, comprising the steps of:

a. providing a detergent composition or components thereof;

b. incorporating the external structuring system of claim 1 in the detergent composition or components thereof.

* * * * *